United States Patent [19]

Kuo

[11] Patent Number: 4,865,313

[45] Date of Patent: Sep. 12, 1989

[54] RUNNING EXERCISER

[76] Inventor: Hai Pin Kuo, Che-Lu-Chien No. 30, Pao-An-Tsun, Jen-Teh Hsiang, Taiwan

[21] Appl. No.: 182,209

[22] Filed: Apr. 15, 1988

[51] Int. Cl.[4] ..... A63B 23/06

[52] U.S. Cl. ..... 272/69; 272/DIG. 4; 74/200; 474/69

[58] Field of Search ..... 272/69, DIG. 4; 74/199, 74/200, 193; 474/69, 70

[56] References Cited

U.S. PATENT DOCUMENTS

| | | | |
|---|---|---|---|
| 159,589 | 2/1875 | Lindner | 74/193 |
| 1,806,984 | 5/1931 | Prout | 74/199 |
| 3,066,544 | 12/1962 | Louis | 74/200 |
| 3,240,078 | 3/1966 | Newell | 74/200 |
| 3,302,474 | 2/1967 | Edlich | 74/200 |
| 4,374,587 | 2/1983 | Ogden | 272/69 |

FOREIGN PATENT DOCUMENTS

| | | | |
|---|---|---|---|
| 966865 | 4/1975 | Canada | 272/69 |

*Primary Examiner*—Richard J. Apley
*Assistant Examiner*—Franklin L. Gubernick
*Attorney, Agent, or Firm*—Morton J. Rosenberg; David I. Klein

[57] ABSTRACT

This invention relates to a running exerciser and in particular to one including a base frame on which there is fixedly mounted a motor. An endless belt is carried on a front rod and a rear rod in the base frame. A driving wheel with a conical surface is mounted on an axle of the motor. A driven wheel is installed at one end of the front rod and has a conical surface. Between the driving wheel and the driven wheel is a controlling conical disc provided with a frictional ring on the circumference thereof which partially contacts the conical surfaces of the driving wheel and the driven wheel. When the controlling disc is slightly moved towards or away from the driven wheel, the interconnection among the controlling conical disc and the driving and driven wheels will be changed thereby effectively increasing or decreasing the speed of the running exerciser.

3 Claims, 4 Drawing Sheets

RUNNING EXERCISER

BACKGROUND OF THE INVENTION

This invention generally relates to a running exerciser and more particularly to a running exerciser with a sensitive and effective speed changing device.

Medical research has shown that regular vigorous excercise helps to keep the body in good tone, reduces back problems and decreases the incidence of heart disease by a substantial factor. Since heart disease causes a substantial number of deaths, regular exercise may well increase longevity significantly.

Common means of obtaining vigorous exercise are swimming, basketball and tennis. However, many people find that these forms of exercise are difficult to obtain because, expensive often, crowded and distant facilities are usually required. Because of these difficulties, various types of exercise devices for obtaining vigorous exercise in the home have been developed and the running exerciser is the most popular one. However, all of the running exercisers on the market have a disadvantage that they cannot be sensitively and effectively adjusted in speed.

Accordingly, it is an object of the invention to provide a running exerciser which may overcome the above-mentioned deficiency.

SUMMARY OF THE INVENTION

This invention relates to a running exerciser with improved speed changing means.

It is the primary object of the invention to provide a running exerciser which utilizes the displacement of a controlling conical disc to change the interconnection among the controlling conical disc, the driving wheel and the driven wheel so as to increase or decrease the speed of the endless belt.

It is another object of the present invention to provide a running exerciser having a driving wheel connected with a resilient means and a driven wheel fixedly mounted on the front axle.

In accordance with the principles of the present invention, the running exerciser comprises a base frame on which there is fixedly mounted a motor. An endless belt is carried on a front rod and a rear rod in the base frame. A driving wheel with a conical surface is mounted on an axle of the motor. A driven wheel is installed at one end of the front rod and has a conical surface. Between the driving wheel and the driven wheel is a controlling conical disc provided with a frictional ring on the circumference thereof which partially contacts the conical surfaces of the driving wheel and the driven wheel. When the controlling disc is slightly moved towards or away form the driven wheel, the interconnection among the controlling conical disc and the driving and driven wheels will be changed thereby effectively increasing or decreasing the speed of the running exerciser.

DETAILED DESCRIPTION OF THE PREFERRED EMBODIMENTS

Figure 1:
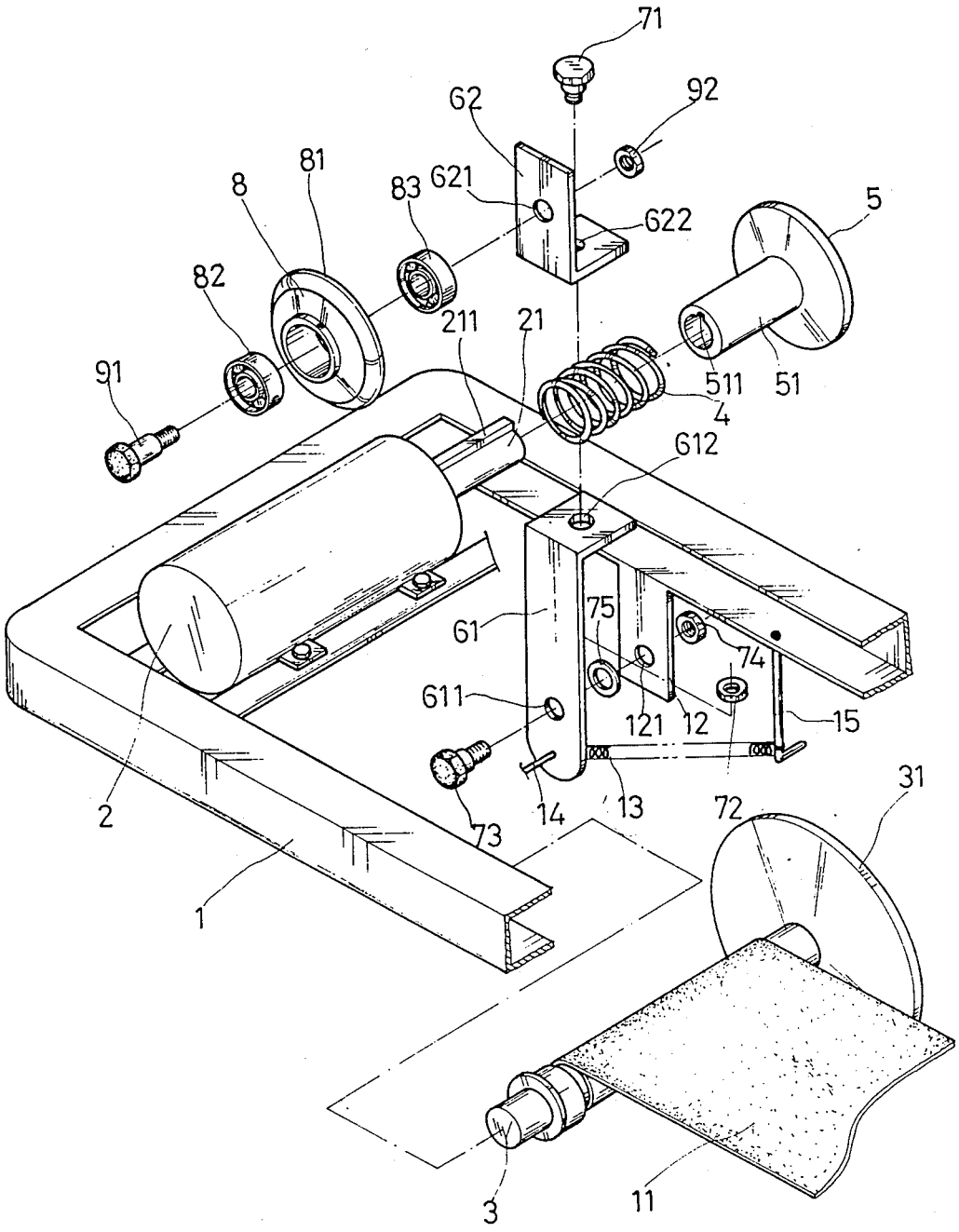
FIG. 1 is an exploded view of the present invention.

With reference to the drawings and in particular to FIG. 1 thereof, the running exerciser according to the present invention comprises a base frame 1 on which is fixedly mounted a motor 2. An endless belt 11 is carried on a front rod 3 and a rear rod in the base frame. The motor 2 has an axle 21 provided with a key 211 thereon and a resilient means such as a helical spring 4 is put over the axle 21. A driving wheel 5 with an inner conical surface and a tubular portion 51 having a keyway 51 is slidingly engaged over the axle 21, with the key 211 of the axle 21 received in the keyway 511 of the driving wheel 5. The front rod 3 is provided at one end with a driven wheel 31 which is also formed with a conical surface. Between the driving wheel 5 and the driven wheel 31 there is a shoulder 12 extending downwardly from the base frame 1 and having a circular hole 121.

Figure 3:
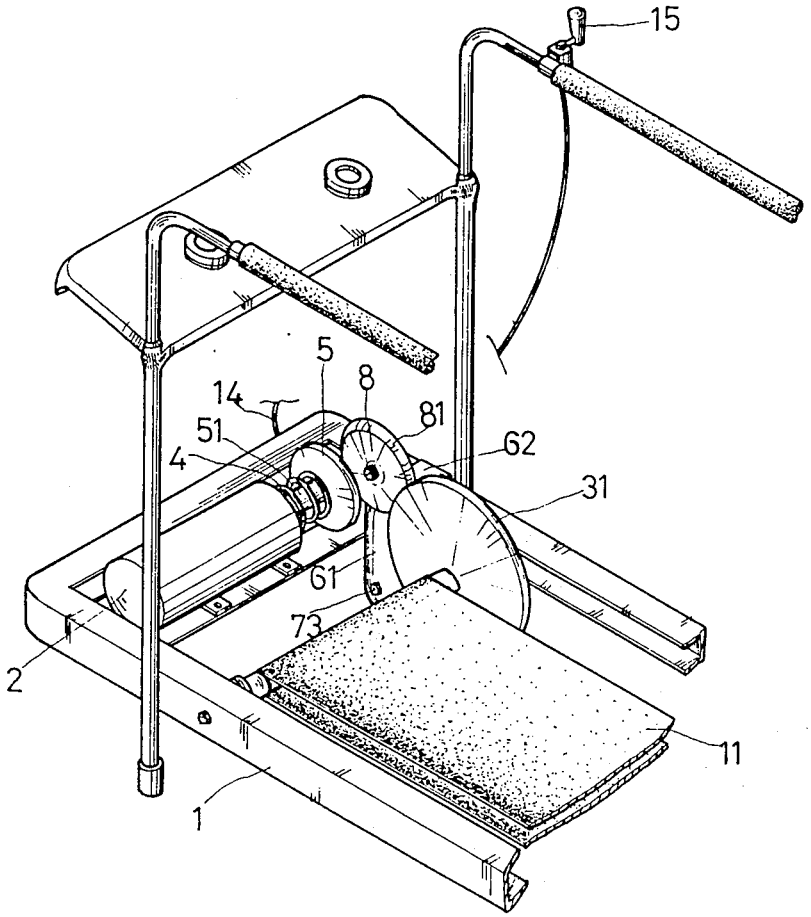
FIG. 3 is a perspective view of the present invention.

A pivotedly movable L-shaped member 61 and a horizontally movable L-shaped member 62 are used to form a lever frame, which members are respectively provided with holes 611, 612 and 621, 622. The member 62 is joined to the member 61 by a screw 71 and a nut 72 through the holes 622 and 612. The member 62 is rotatably joined to the member 61. A stud 73 extends through the hole 611 of the member 61 and the hole 121 of the shoulder 12 and then engaged with a nut 74 so that the lever frame may turn about the stud 73. In order to decrease the frictional force between the stud 73 and the shoulder 123, a packing 75 is disposed therebetween so as to facilitate the movement of the stud 73. The lower end of the member 61 is connected at one side with a spring 13 and at the other side with a steel wire 14. The other end of the spring 13 is connected to a hook 15 fixed on the base frame 1 while the other end of the wire 14 is joined to an adjusting means 15 (see FIG. 3) which may be turned to pull the wire 14 so as to move the lower end of the lever frame towards the driving wheel 5. In the meantime, the spring 13 is stretched. In case the wire 14 is released, the lower end of the lever frame may be pulled back from the driving wheel 5 by the restoring force of the spring 13.

Figure 2:
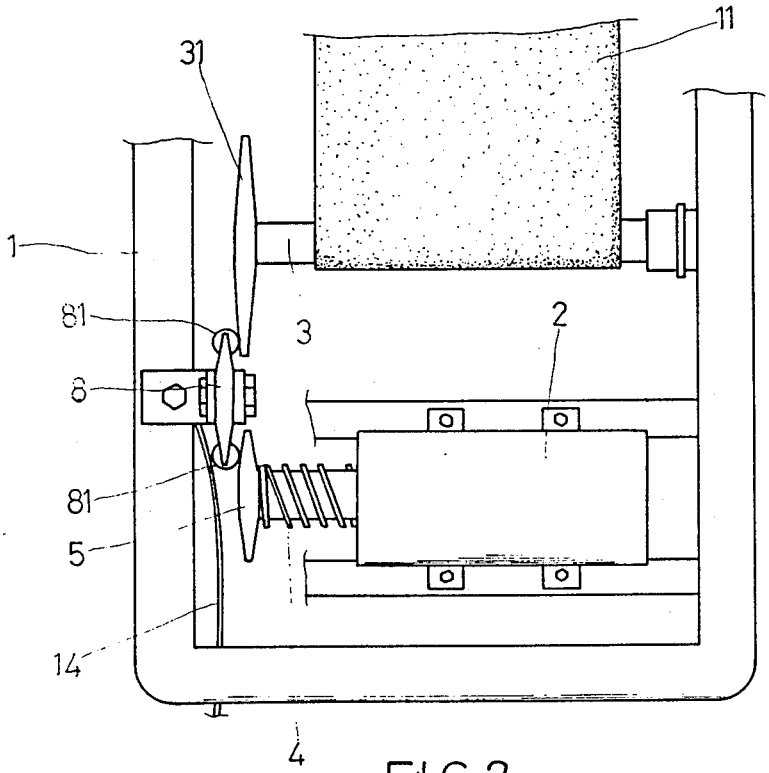
FIG. 2 is a plan view of the present invention.

A controlling conical disc 8 having a frictional ring 81 (non-metal) at the center is fitted to the lever frame by a stud 91 extending through the bearings 82 and 83 and the hole 621 of the frame 62 to engage with a nut 92. At that time, the frictional ring 81 of the controlling conical disc 8 will be in contact with the conical surface of the driving wheel 5 and the driven wheel 31 (see FIGS. 2 and 3).

Figure 4:
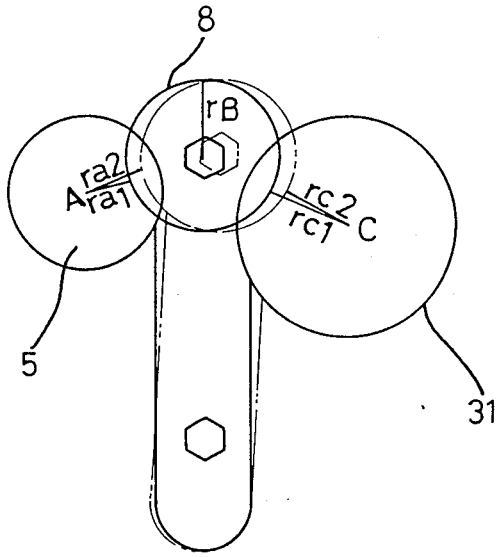
FIG. 4 shows the principle of the present invention.
Figure 4:
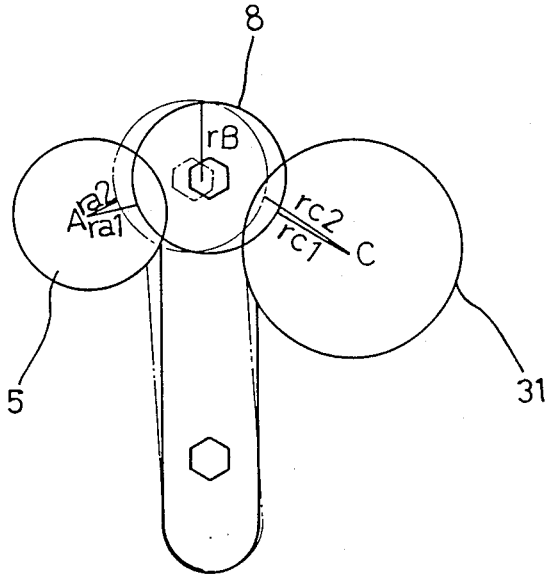

As stated above, the lever frame may rotate clockwise or counterclockwise by means of the steel wire 14 and the spring 13. In case of any movement of the controlling conical disc 8, the coupling condition among the driving wheel 5, the driven wheel 31 and the controlling conical disc 8 will be changed, i.e. producing multiple effect of speed changing. With reference to FIG. 4, when the lever frame is disposed vertically, the controlling conical disc 8 will be in contact with the driving wheel 5 at A1 and the driven wheel 31 at C1 wherein A1 and C1 refer to the nearest distances between circumference of the controlling conical disc 8 and the centers of the driving wheel 5 and the driven wheel 31 respectively. Supposing the distance between A1 and the center A of the driving wheel 5 be rA1 and the distance between C1 and the center C be rC1, the new intersecting points will be A2 and C2 and the new distances rA2 and rC2 when the controlling conical wheel 8 is biased by the driven wheel 31. Hence, if the speed of the driving wheel 5 is NA (constant speed), the radius of the controlling conical wheel 8 is rB, the speed of the controlling conical wheel 8 is NB and the speed of the driven wheel is NC, then we have $$rA1/rB=NB/NA,$$

$$NB/NC=rC1/rB$$

$$NB=(rA/rB)NA,$$

$$NC=(rB/rC1)NB$$

Since rB and NA are constants, when rA1 changes to rA2 (rA2>rA1), then $$NB'=(rA2/rB)NA=(rA2/rA1)NB$$

That is, the speed of the controlling conical wheel is increased. As to the driven wheel, since NB and rC1 are variables, NC' will be greater than NC if Nb'>NB and rC2<rC1 and thereby increase the speed of the driven wheel 31.

In case the contolling conical wheel 8 is moved towards the driving wheel 5, NC' will be smaller than NC if rA2<rA1 and rC2>rC1 thereby decreasing the speed of the driven wheel 31.

Conclusively, slight movement of the controlling conical wheel 8 will effectively increase or decrease the speed of the running exerciser.

Figure 5:
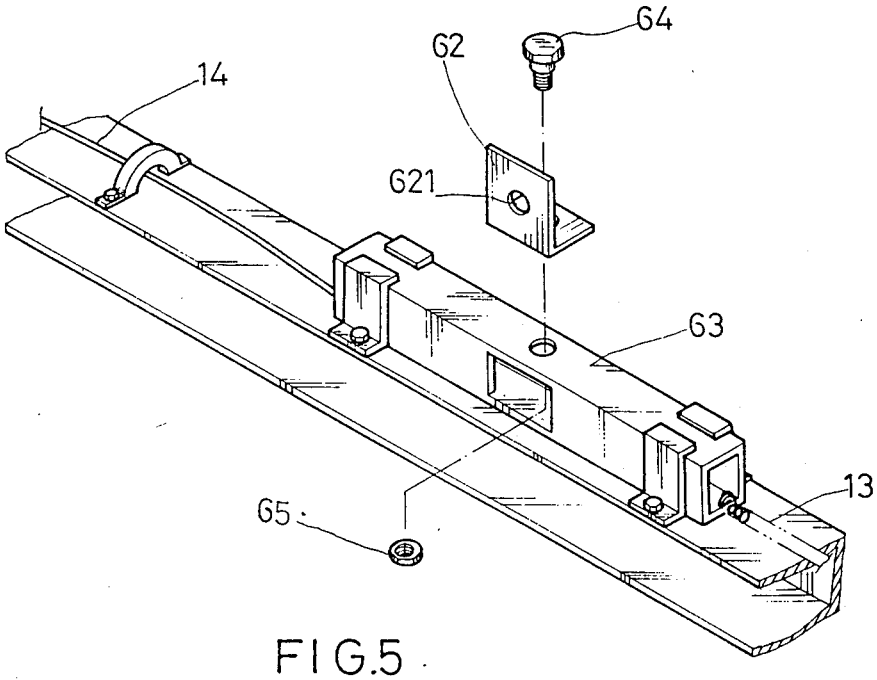
FIG. 5 is another preferred embodiment of the present invention.

It should be noted, however, that the lever frame can be replaced with a translational sliding rod 63 as shown in FIG. 5. The sliding rod 63 is connected to the steel wire 14 at one end and the spring 13 at the other end. The L-shaped member 62 and the sliding rod 63 are pivotally joined together to form an integral body. The hole 621 of the L-shaped member 62 is still provided with a controlling conical wheel 8 as mentioned above.

When the controlling conical disc 8 is moved towards the driving wheel 5, the resilient element 4 will naturally produce a reaction force which will urge the controlling conical wheel 8 to move but the frictional ring 81 will still be in contact with the conical surface of the driving and the driven wheels 5 and 31 thereby preventing the three members separating from one another.

While the invention has been particularly shown and described with reference to preferred embodiments thereof, it will be understood by those skilled in the art that various changes in form and detail may be made therein without departing from the spirit and scope of the invention as defined in the appended claims.

I claim:

1. A running exerciser comprising a base frame on which is fixedly mounted a motor;

an endless belt carried on a front rod and a rear rod positioned within said base frame;

a driving wheel having a conical surface slidingly mounted on an axle of said motor;

a driven wheel mounted on one end of said front rod and having a conical surface for displacing said endless belt at a predetermined speed;

a lever frame disposed between said driving wheel and said driven wheel and movably connected to said base frame, said lever frame having a rotatably mounted controlling conical disc provided with a frictional ring on a circumference portion thereof for frictionally engaging a portion of both said conical surface of said driving wheel and said conical surface of said driven wheel; and a lever frame moving means operatively connected to said lever frame whereby actuation of said moving means causes a horizontal displacement of said controlling conical disc in a direction substantially perpendicular to said motor axle and thereby changes a drive ratio between said driven wheel and said driving wheel and thereby effectively increasing or decreasing said predetermined speed of said endless belt responsive to said displacement direction being toward or away from said motor axle.

2. The running exerciser as claimed in claim 1, wherein said lever frame comprises a movable L-shaped member pivotally mounted on said base frame and a horizontally displaceable L-shaped member pivotedly coupled on a top thereof, said horizontally displaceable L-shaped member coupled to said controlling conical disc for said displacement thereof, said movable L-shaped member having a lower end connected on one side with a steel wire and on an opposing side with a spring for positioning said horizontally displaceable L-shaped member.

3. The running exerciser as claimed in claim 1, wherein said lever frame includes a sliding rod horizontally movable along said base frame and an L-shaped member pivotedly coupled thereto, said L-shaped member being coupled to said controlling conical disc for said displacement thereof responsive to displacement of said sliding rod by forces applied by a wire coupled on one end of said rod and a spring coupled to the opposing end.

* * * * *